US009222295B2

(12) United States Patent
Umemura

(10) Patent No.: US 9,222,295 B2
(45) Date of Patent: Dec. 29, 2015

(54) WINDOW REGULATOR

(75) Inventor: Taiji Umemura, Takarazuka (JP)

(73) Assignee: HI-LEX CORPORATION, Hyogo (JP)

( * ) Notice: Subject to any disclaimer, the term of this patent is extended or adjusted under 35 U.S.C. 154(b) by 0 days.

(21) Appl. No.: 14/122,670

(22) PCT Filed: May 31, 2012

(86) PCT No.: PCT/JP2012/064032

§ 371 (c)(1),
(2), (4) Date: Nov. 26, 2013

(87) PCT Pub. No.: WO2012/165527

PCT Pub. Date: Dec. 6, 2012

(65) Prior Publication Data

US 2014/0109481 A1 Apr. 24, 2014

(30) Foreign Application Priority Data

May 31, 2011 (JP) ..... 2011-121144

(51) Int. Cl.
*E05F 11/48* (2006.01)

(52) U.S. Cl.
CPC ..... *E05F 11/483* (2013.01); *E05Y 2900/55* (2013.01)

(58) Field of Classification Search
USPC ..... 49/348, 349, 352
IPC ..... E05F 11/483; E05Y 2900/55
See application file for complete search history.

(56) References Cited

U.S. PATENT DOCUMENTS

| | | | | | |
|---|---|---|---|---|---|
| 4,502,247 | A * | 3/1985 | Kobayashi et al. | ..... | 49/352 |
| 4,550,529 | A * | 11/1985 | Drouillard | ..... | 49/348 |
| 5,079,871 | A * | 1/1992 | Acciacca et al. | ..... | 49/351 |
| 5,884,434 | A * | 3/1999 | Dedrich et al. | ..... | 49/503 |
| 6,088,965 | A * | 7/2000 | Fukumoto et al. | ..... | 49/352 |
| 2003/0140562 | A1 * | 7/2003 | Staser et al. | ..... | 49/352 |
| 2004/0154227 | A1 * | 8/2004 | Yoshimura | ..... | 49/352 |
| 2008/0005971 | A1 * | 1/2008 | Dickie et al. | ..... | 49/349 |

FOREIGN PATENT DOCUMENTS

| | | | |
|---|---|---|---|
| JP | H01-131785 | U1 | 9/1989 |
| JP | H08-270328 | A | 10/1996 |
| JP | 2000-356068 | A | 12/2000 |
| JP | 4637522 | B2 | 2/2011 |

OTHER PUBLICATIONS

International Search Report of corresponding International Application No. PCT/JP2012/064032, dated Aug. 14, 2012.

* cited by examiner

*Primary Examiner* — Gregory Strimbu
(74) *Attorney, Agent, or Firm* — Global IP Counselors, LLP

(57) ABSTRACT

A window regulator includes: a guide rail including a rail main body part, an insert-through part provided at one end of the rail main body part and inserted into a housing, and a locking tab provided at the rail main body part. The housing includes a housing part housing the insert-through part, an engaging part engaging with a tip of the locking tab, and a guide part configured to guide the tip of the locking tab to the engaging part when the tip of the locking tab is brought into contact with the guide part. The engagement of the locking tab and the engaging part restricts movement of the housing in a longitudinal direction of the rail main body part toward the one end of the rail main body part.

4 Claims, 4 Drawing Sheets

WINDOW REGULATOR

CROSS-REFERENCE TO RELATED APPLICATIONS

This U.S. National stage application claims priority under 35 U.S.C. §119(a) to Japanese Patent Application No. 2011-121144, filed in Japan on May 31, 2011, the entire contents of Japanese Patent Application No. 2011-121144 are hereby incorporated herein by reference.

BACKGROUND

1. Field of the Invention

The present invention relates to a window regulator that is adapted to a door of a vehicle.

2. Background Information

A window regulator that is used by being fixed to an inner panel of a door of a vehicle generally includes: a glass holder, to which window glass is fixed; a carrier plate, which is connected to the glass holder; a wire for raising and a wire for lowering, one end of each of which is connected to the carrier plate; a wire guide, which modifies the wire layout direction of the wires; a drum, to which other ends of the wires are connected; and a drive part that vertically moves the window glass, which is fixed to the glass holder, together with the carrier plate by the rotation of the drum such that one of the wires is wound up and the other is payed out. This window regulator requires that tension always be applied to the wires.

Taking this into consideration, Japanese Unexamined Patent Application Publication No. H8-270328 discloses a window regulator that integrally joins a bracket, to which the wire guide is provided, to one end of a guide rail in the state wherein tension is applied to the wires. In addition, Japanese Unexamined Patent Application Publication No. 2000-356068 discloses a window regulator that includes: a bracket, to which a wire guide is provided; and a base bracket, which rotatably holds the bracket and is capable of fixing the bracket at an arbitrary position via a bolt and a nut. In the window regulator, the bracket is rotated to a position at which tension is applied to the wires and then is fixed to the base bracket at that position.

SUMMARY

Nevertheless, in the window regulator disclosed in Japanese Unexamined Patent Application Publication No. H8-270328, a mating structure is not provided between the bracket and the guide rail, and therefore, when integrally joining the bracket and the guide rail, it is necessary to perform this work while using manufacturing equipment for positioning so that they do not tilt toward one another. Consequently, the manufacture of the window regulator is complicated, which is a problem.

In addition, in the window regulator disclosed in Japanese Unexamined Patent Application Publication No. 2000-356068, it is necessary to fix the bracket to the base bracket via the bolt and the nut while maintaining the state wherein tension is applied to the wires. Consequently, the manufacture of the window regulator is complicated, which is a problem. Furthermore, there is also the problem in that, if the nut loosens during usage of the window regulator, then the bracket will adversely move in a direction in which the tension of the wires decreases.

The present invention was conceived considering the aforementioned problems, and an object of the present invention is to provide a window regulator that is easy to manufacture and that can apply tension to wires reliably.

To achieve the aforementioned object, a window regulator of the present invention includes: a carrier plate to which a window glass is fixed; a guide rail configured to guide movement of the carrier plate; a housing provided at one end of the guide rail; a wire guide provided at an other end of the guide rail; a drum housed in the housing; a wire for raising wound around the wire guide and having one end connected to the carrier plate and an other end connected to the drum; a wire for lowering having one end connected to the carrier plate and an other end connected to the drum; and a drive part configured to rotationally drive the drum. The guide rail includes a rail main body part, an insert-through part provided at one end of the rail main body part and inserted into the housing, and a locking tab provided at the rail main body part. The housing includes a housing part housing the insert-through part, an engaging part engaging with a tip of the locking tab, and a guide part configured to guide the tip of the locking tab to the engaging part if the tip of the locking tab is brought into contact with the guide part, with the locking tab being tilted toward the engaging part. The engagement of the locking tab and the engaging part restricts movement of the housing in a longitudinal direction of the guide rail toward the other end of the guide rail.

(1) In the window regulator of the present invention, the tip of the locking tab, which is provided at the guide rail that guides the movement of the carrier plate to which the window glass is fixed, and the engaging part, which is provided at the housing that houses the drum connected to the other ends of the wire for raising and the wire for lowering, engage, which makes it possible to restrict the movement of the housing in the longitudinal directions of the guide rail toward the other end of the guide rail. In addition, in the present window regulator, even if the tip of the locking tab and the engaging part do not engage, the guide part provided at the housing guides the tip of the locking tab to the engaging part, and therefore the tip of the locking tab can be caused to engage with the engaging part without performing any additional fabrication work. Accordingly, in the present window regulator, manufacturing is easy and it is possible to reliably apply tension to the wire for raising and the wire for lowering.

(2) In the window regulator of the present invention, the locking tab includes a portion at which the guide rail main body part is bent such that the locking tab protrudes from the guide rail main body part of the guide rail. Accordingly, the present window regulator can be manufactured much more easily without the need to configure the locking tab as a separate member.

(3) In the window regulator of the present invention, the guide part, which is tilted toward the engaging part, guides the tip of the locking tab to the engaging part while making sliding contact with the tip of the locking tab. Accordingly, in the present window regulator, the tip of the locking tab and the engaging part engage reliably, the locking tab is much easier to manufacture, and the tension of the wire for raising and the wire for lowering is stable.

(4) In the window regulator of the present invention, the engaging tab is formed wide and extends toward the housing. Thereby, in the present window regulator, the stiffness of the locking tab is improved and it is possible to stably restrict the movement of the housing in the direction in which the tension of the wire for raising and the wire for lowering decreases; therefore, it is possible to apply tension to the wire for raising and the wire for lowering much more reliably.

DETAILED DESCRIPTION OF EMBODIMENTS

Figure 1:
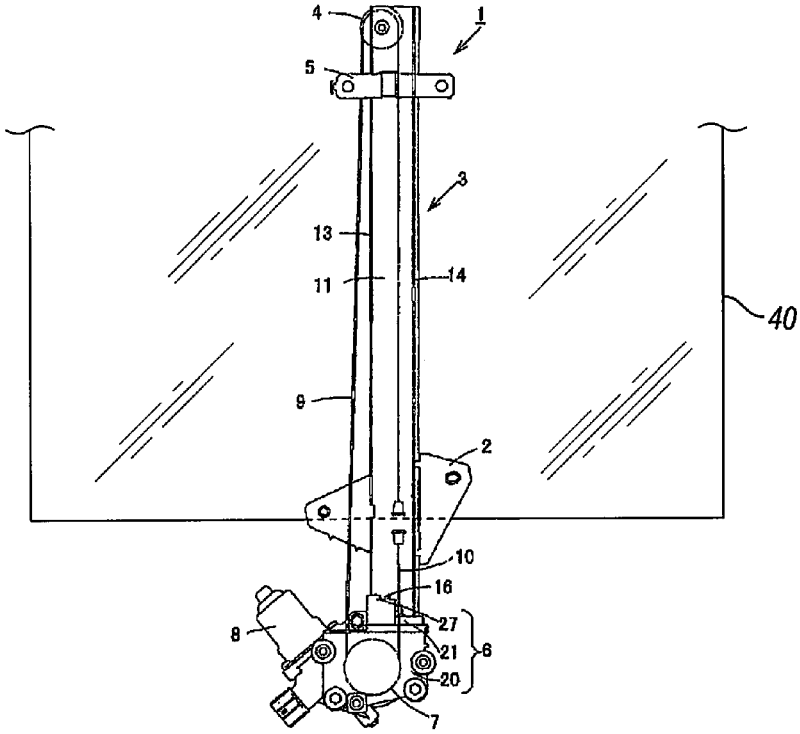
FIG. 1 is a front view of a window regulator according to the present invention.

An embodiment of the present invention will be explained below, referencing the drawings. A window regulator 1 of the present invention is used by being fixed to an inner panel of a vehicle door (outside the drawing). As shown in FIG. 1, the window regulator 1 includes: a carrier plate 2, to which is fixed a glass holder (outside the drawing), whereto a window glass 40 is fixed; a guide rail 3, which guides, and thereby raises and lowers, the carrier plate 2; a wire guide 4, which is attached to the guide rail 3 in the vicinity of its upper end; a bracket 5, which is attached to the guide rail 3 below the wire guide 4 by a prescribed distance and is used to fix the window regulator 1 to the inner panel of the door; a housing 6, which is attached to a lower end of the guide rail 3; a drum 7, which is housed inside the housing 6, and a drive part 8, which is attached to the housing 6 and rotates the drum 7. Furthermore, in the present window regulator 1, a wire for raising 9 is wound around the wire guide 4, with one end connected to the carrier plate 2 and an other end connected to the drum 7. One end of a wire for lowering 10 is connected to the carrier plate 2 and an other end is connected to the drum 7.

By adopting the abovementioned configuration, in the window regulator 1 of the present invention, the window glass 40 is raised by the drive part 8 rotationally driving the drum 7, thereby winding the wire for raising 9 around the drum 7 and paying out the wire for lowering 10 from the drum 7 toward the one end side. In the window regulator 1 of the present invention, the window glass 40 is lowered by paying out the wire for raising 9 from the drum 7 toward the one end side and winding the wire for lowering 10 around the drum 7.

The window regulator 1 is characterized by its configuration of the guide rail 3 and the housing 6; for other constituent elements of the window regulator 1, those well known in the art can be used. Accordingly, the explanation below focuses on the configuration of the guide rail 3 and the housing 6.

Figure 2:
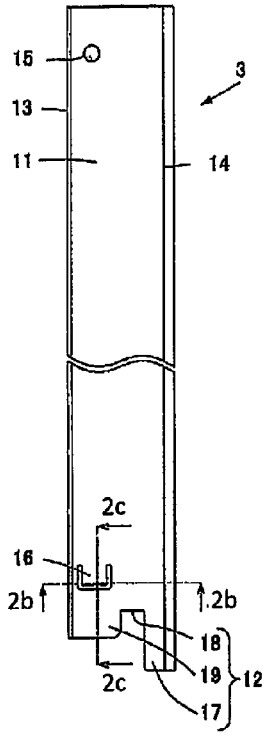
FIGS. 2(*a*) through 2(*c*) are drawings of a guide rail, wherein FIG. 2(*a*) is an enlarged front view, FIG. 2(*b*) is an enlarged cross sectional view taken along the 2(*b*)-2(*b*) line, and FIG. 2(*c*) is an enlarged cross sectional view taken along the 2(*c*)-2(*c*) line.
Figure 2:
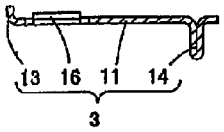
Figure 2:
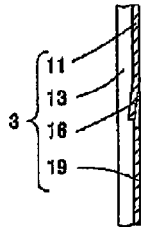

As shown in FIGS. 2(*a*) through 2(*c*), the guide rail 3 is made by forming a metal sheet, such as a substantially oblong zinc plated steel sheet that has a prescribed length in the vertical directions, into a prescribed shape. The guide rail 3 includes: a rail main body part 11, which extends vertically; and an insert-through part 12, which is provided to a lower end of the rail main body part 11 and is inserted through the housing 6 shown in FIGS. 3(*a*) through 3(*c*). In the guide rail 3, a bent part 13, which is bent at substantially a right angle to an edge of one end in the width directions, and a double bent part 14, which is formed on the inner side at a prescribed distance from the other end in the width directions and is double folded and protrudes in a direction the opposite of the bent part 13.

Figure 3:
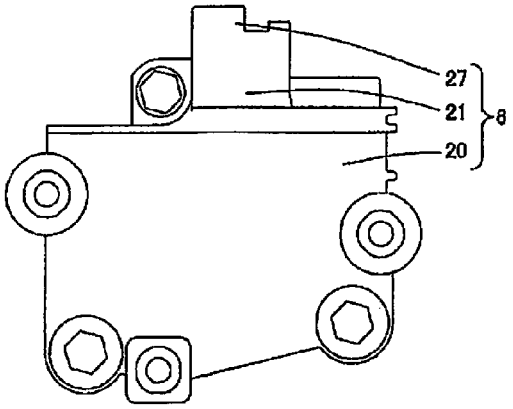
FIGS. 3(*a*) through 3(*c*) are drawings of a housing, wherein FIG. 3(*a*) is an enlarged front view, FIG. 3(*b*) is an enlarged plan view, and FIG. 3(*c*) is an enlarged cross sectional view taken along the 3(*c*)-3(*c*) line.
Figure 3:
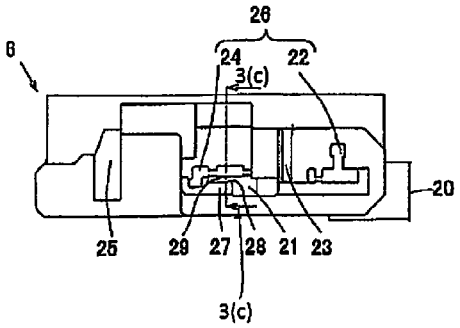
Figure 3:
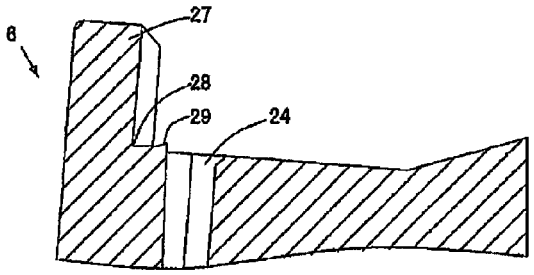

The rail main body part 11 includes: a through hole 15, which is provided in an upper end vicinity and is for rotatably attaching the wire guide 4 shown in FIG. 1; and a locking tab 16, which is provided in a lower end vicinity and latches the housing 6 shown in FIG. 3 FIGS. 3(*a*) through 3(*c*).

As is clearly shown in FIG. 2(*a*), the locking tab 16 is a rectangular sheet whose upper edge is connected to the rail main body part 11, that has a prescribed width in the width directions of the rail main body part 11, and that extends toward the direction of the lower end of the rail main body part 11. The locking tab 16 is formed integrally with the rail main body part 11 by stamping the rail main body part 11. As is clearly shown in FIG. 2(*b*), (*c*), the locking tab 16 is bent by a prescribed angle at its upper edge such that its lower edge protrudes in the same direction as the bent part 13.

As shown in FIG. 2(*a*), the insert-through part 12 includes: a rectangular first insert-through part 17, which is formed such that it includes the double bent part 14; and a rectangular second insert-through part 19, which is provided interposing a notched part 18 between it and the first insert-through part 17 and is formed such that it is located below the locking tab 16 and includes the bent part 13. Compared with the second insert-through part 19, the first insert-through part 17 is formed such that it is narrower in the width directions of the guide rail 3 and longer in the longitudinal directions of the guide rail 3.

The housing 6 is made of a material such as resin or metal and, as shown in FIGS. 3(*a*) through 3(*c*), includes: a main body part 20, in which is formed a drum housing part (outside the drawing) that rotatably houses the drum 7 shown in FIG. 1; and a protruding part 21, which protrudes from an upper surface of the main body part 20.

As is clearly shown in FIG. 3(*b*), the following are formed as openings that face upward in the protruding part 21, from in the vicinity of the right side end of the upper surface to the left side end in the following order: a first housing part 22, which houses the first insert-through part 17 shown in FIG. 2(*a*); a wire for lowering guide groove 23, which communicates with the drum housing part (outside the drawing) and wherethrough the wire for lowering 10 shown in FIG. 1 is inserted; a second housing part 24, which houses the second insert-through part 19 shown in FIG. 2(*a*); and a wire for raising guide groove 25, which communicates with the drum housing part and wherethrough the wire for raising 9 shown in FIG. 1 is inserted. Furthermore, the first housing part 22 and the second housing part 24 constitute a housing part 26, which permits the first insert-through part 17 and the second insert-through part 19 to move in the longitudinal directions of the guide rail 3, and restricts the movement of the first insert-through part 17 and the second insert-through part 19 in directions perpendicular to the longitudinal directions of the guide rail 3.

As is clearly shown in FIG. 3(*c*), the protruding part 21 includes a protruding plate 27, which is provided such that it stands upward from the front side upper surface of the second housing part 24 (refer to FIG. 3(*a*), (*b*)). The protruding part 21 includes an engaging part 28 that joins with a tip of the locking tab 16, which is shown in FIGS. 2(*a*) through 2(*c*), proximate to the corner part at which a rear side surface of the protruding plate 27 and the upper surface of the protruding part 21 are joined. By forming, in the upper surface between the second housing part 24 and the protruding plate 27, a tilted surface that is tilted downward from the second housing part 24 side toward the engaging part 28, the protruding part 21 includes a guide part 29 that guides the tip of the locking tab 16 to the engaging part 28. Furthermore, the guide part 29 is not limited to a tilted surface and may be any shape as long as it can guide the tip of the locking tab 16 to the engaging part 28.

Figure 4:
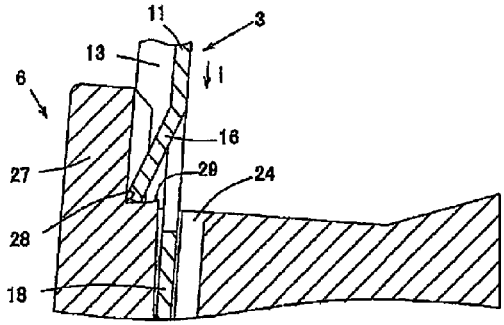
FIGS. 4(*a*) and 4(*b*) are enlarged cross sectional views of the principal parts for explaining the assembly of the guide rail and the housing.
Figure 4:
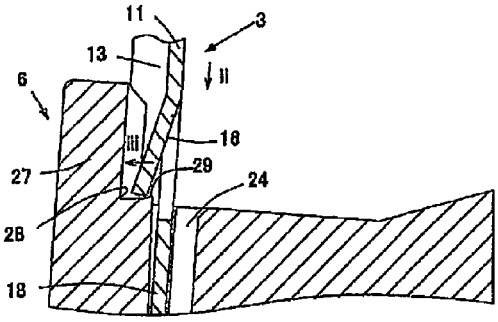

The assembly of the guide rail 3 and the housing 6, which include the various parts described above, will now be explained. In this assembly, the first insert-through part 17 and the second insert-through part 19 of the insert-through part 12 of the guide rail 3 are inserted into the first housing part 22 and the second housing part 24, respectively, of the housing part 26 of the housing 6; furthermore, as shown in FIG. 4(*a*), the guide rail 3 is moved downward relative to the housing 6 (an arrow i). At this time, if the bend angle at the upper edge of the locking tab 16 formed in the rail main body part 11 of the guide rail 3 is proper, then the tip of the locking tab 16 will engage with the engaging part 28 of the housing 6.

Here, as shown in FIG. 2(*a*), the locking tab 16 extends toward the lower end direction of the rail main body part 11, namely, toward the direction of the housing 6. The locking tab 16 is formed wide and has a stiffness that, when the tip of the locking tab 16 engages with the engaging part 28 of the housing 6 as shown in FIG. 4(*a*), makes it possible to stably restrict the movement of the housing 6 with respect to the guide rail 3 in the upward direction of the longitudinal directions of the guide rail 3, namely, in the direction toward the end of the guide rail 3 at which the wire guide 4 is disposed. Accordingly, the engagement of the tip of the locking tab 16 with the engaging part 28 restricts the movement of the housing 6 in the direction toward the end of the guide rail 3 at which the wire guide 4 is disposed.

If, when the guide rail 3 and the housing 6 are being assembled, the bend angle at the upper edge of the locking tab 16 is insufficient as shown in FIG. 4(*b*), then the first insert-through part 17 and the second insert-through part 19 of the insert-through part 12 of the guide rail 3 are inserted into the first housing part 22 and the second housing part 24, respectively, of the housing part 26 of the housing 6, and, when the guide rail 3 is moved downward relative to the housing 6 (an arrow ii), the tip of the locking tab 16 is brought into contact with the guide part 29 of the housing 6.

In this state, when the guide rail 3 is further moved downward relative to the housing 6, the bend angle at the upper edge of the locking tab 16 increases as the tip of the locking tab 16 is guided to the engaging part 28 while in sliding contact with the guide part 29, which is tilted toward the engaging part 28 (an arrow iii). Thereby, the engagement of the tip of the locking tab 16 with the engaging part 28 restricts movement of the housing 6 in the direction in which the tension of the wire for raising 9 and the wire for lowering 10 decreases.

In the window regulator 1 of the present invention as explained above, the tip of the locking tab 16, which has improved stiffness by virtue of being formed wide and is provided to the rail main body part 11 of the guide rail 3 that guides the carrier plate 2 to which is fixed the glass holder (outside the drawing) whereto the window glass 40 is fixed, and the engaging part 28, which is provided to the housing 6 that houses the drum 7 connected to the other ends of the wire for raising 9 and the wire for lowering 10, engage. Thereby, in the window regulator 1, it is possible to restrict the movement of the housing 6 in the direction in which the tension of the wire for raising 9 and the wire for lowering 10 decreases.

In the window regulator 1 of the present invention, the locking tab 16 is formed of a portion which is bent at the rail main body part 11 of the guide rail 3, and therefore there is no need to configure the locking tab 16 as a member separate from the rail main body part 11, making the locking tab 16 much easier to manufacture.

The window regulator 1 of the present invention includes the guide part 29, which is a tilted surface of the housing 6 tilting to the engaging part 28. Consequently, in the window regulator 1, even if the bend angle at the upper edge of the locking tab 16 is insufficient and the tip of the locking tab 16 does not engage with the engaging part 28, the tip of the locking tab 16 is guided to the engaging part 28 while the guide part 29 is in sliding contact with the tip of the locking tab 16. Thereby, in the window regulator 1, the tip of the locking tab 16 can be reliably engaged with the engaging part 28 without performing any additional fabrication work and it is possible to restrict the movement of the housing 6 in the direction in which the tension of the wire for raising 9 and the wire for lowering 10 decreases. Consequently, in the window regulator 1, manufacturing is simple and tension can be applied reliably to the wire for raising 9 and the wire for lowering 10. In addition, the tension of the wire for raising 9 and the wire for lowering 10 can be stabilized.

Furthermore, the window regulator 1 described in the present embodiment is merely one aspect of the window regulator according to the present invention, and it is understood that variations and modifications may be effected without departing from the spirit and scope of the invention.

The window regulator according to the present invention can be adapted to a vehicle door.

The invention claimed is:

1. A window regulator comprising:

a carrier plate to which a window glass is fixed;

a guide rail configured to guide movement of the carrier plate there along;

a housing provided at a first end of the guide rail;

a wire guide provided at a second end of the guide rail;

a drum housed in the housing;

a first wire, for raising the carrier plate, wound around the wire guide and having a first end thereof connected to the carrier plate and a second end thereof connected to the drum;

a second wire, for lowering the carrier plate, having a first end thereof connected to the carrier plate and a second end thereof connected to the drum; and a drive part configured to rotationally drive the drum;

the guide rail including a rail main body part, an insert-through part provided at one end of the rail main body part and inserted into the housing, and a locking tab provided on the rail main body part;

the housing including a housing part housing the insert-through part, an engaging part engaging with a tip of the locking tab, and a guide part configured to guide the tip of the locking tab to the engaging part when the tip of the locking tab is brought into contact with the guide part, the locking tab angled away from the rail main body part and toward the engaging part; and the engagement of the locking tab and the engaging part restricting movement of the housing in a longitudinal direction of the guide rail toward the second end of the guide rail.

2. A window regulator according to claim 1, wherein the guide part is angled toward the engaging part so as to slidably guide the tip of the locking tab to the engaging part.

3. A window regulator according to claim 2, wherein the locking tab is a portion of the rail main body part that is bent relative to the rail main body part such that the locking tab protrudes from the rail main body part.

4. A window regulator according to claim 3, wherein the guide part urges the locking tab away from the rail main body part as the guide part guides the locking tab to the engaging part.

* * * * *